US006866413B2

(12) United States Patent
Donthnier et al.

(10) Patent No.: US 6,866,413 B2
(45) Date of Patent: Mar. 15, 2005

(54) BOWL SCRAPER AND RELATED ATTACHMENT SYSTEM FOR MIXING MACHINE

(75) Inventors: Thomas S. Donthnier, Vandalia, OH (US); Janice J. Schnipke, Springfield, OH (US)

(73) Assignee: Premark FEG L.L.C., Wilmington, DE (US)

( * ) Notice: Subject to any disclaimer, the term of this patent is extended or adjusted under 35 U.S.C. 154(b) by 0 days.

(21) Appl. No.: 10/328,090

(22) Filed: Dec. 23, 2002

(65) Prior Publication Data

US 2004/0120218 A1 Jun. 24, 2004

(51) Int. Cl.[7] ..... B01F 15/00
(52) U.S. Cl. ..... 366/309; 366/331
(58) Field of Search ..... 366/67, 96–98, 366/197–198, 203, 207, 288, 309, 312, 313, 331; 99/348

(56) References Cited

U.S. PATENT DOCUMENTS

| | | | | |
|---|---|---|---|---|
| 535,880 A | | 3/1895 | Anderson | |
| 1,415,735 A | * | 5/1922 | Trust et al. | 366/288 |
| 1,674,903 A | * | 6/1928 | Johnston et al. | 366/288 |
| 1,872,004 A | * | 8/1932 | Rataiczak et al. | 366/309 |
| 2,169,014 A | | 8/1939 | Aalborg | |
| 2,639,904 A | | 5/1953 | McMaster et al. | |
| 3,073,579 A | * | 1/1963 | Detrick | 366/200 |
| 4,311,397 A | * | 1/1982 | Wright | 366/98 |
| 4,436,125 A | | 3/1984 | Blenkush | |
| 4,541,457 A | | 9/1985 | Blenkush | |
| 4,760,984 A | | 8/1988 | Hennessey | |
| 4,857,706 A | | 8/1989 | Diamond | |
| 4,946,285 A | | 8/1990 | Vennemeyer | |
| 5,052,725 A | | 10/1991 | Meyer et al. | |
| 5,104,158 A | | 4/1992 | Meyer et al. | |
| 5,316,041 A | | 5/1994 | Ramacier, Jr. et al. | |
| 5,464,300 A | | 11/1995 | Crainich | |
| 5,494,074 A | | 2/1996 | Ramacier, Jr. et al. | |
| 5,556,201 A | * | 9/1996 | Veltrop et al. | 366/203 |
| 5,791,777 A | | 8/1998 | Mak | |
| 5,911,403 A | | 6/1999 | deCler et al. | |
| 5,938,244 A | | 8/1999 | Meyer | |
| 5,975,489 A | | 11/1999 | deCler et al. | |
| 6,024,124 A | | 2/2000 | Braun et al. | |
| 6,082,401 A | | 7/2000 | Braun et al. | |
| 2002/0181322 A1 | | 12/2002 | Brunswick et al. | |

FOREIGN PATENT DOCUMENTS

| | | |
|---|---|---|
| DE | 1174954 | 7/1964 |
| DE | 2802155 | 7/1979 |
| GB | 246926 A | 2/1926 |
| GB | 308163 A | 3/1929 |
| GB | 889462 | 2/1962 |

OTHER PUBLICATIONS

"General Purpose Couplings, Chrome–Plated Brass, 4" Flow, LC Series,"catalog by CPC, pp. 22–23.
Instructions manual entitled "H600 & L800 Mixers," Hobart Corporation (Dec. 1999).
Service manual entitled "Models H–600 and H–600–T and L–800 Mixers," Hobart Corporation (Sep. 1977).

* cited by examiner

*Primary Examiner*—Charles E. Cooley
(74) *Attorney, Agent, or Firm*—Thompson Hine LLP

(57) ABSTRACT

A bowl scraper is configured for attachment to a rotatable mixing machine support such that forces exerted on the bowl scraper during scraping operations hold the bowl scraper in place.

28 Claims, 6 Drawing Sheets

BOWL SCRAPER AND RELATED ATTACHMENT SYSTEM FOR MIXING MACHINE

TECHNICAL FIELD

The present application relates generally to mixing machines utilized for mixing food products such as cake batter, and more particularly to a mixing machine bowl scraper and related attachment system for the same.

BACKGROUND

The use of bowl scrapers in food mixing machines is known as from U.S. Pat. No. 4,946,285. The scraper is positioned to slide along the interior side of the mixing bowl to remove food product therefrom to assure more thorough mixing. The described arrangement in U.S. Pat. No. 4,946,285 requires the use of moving parts and therefore increases manufacturing costs.

Accordingly, it would be advantageous to provide a mixing machine with an improved bowl scraper and associated attachment system.

SUMMARY

In one aspect, in a mixing machine including a rotatable support extending from a mixer head, a connecting and support system for quickly connecting and disconnecting a bowl scraper is provided. The system includes a bowl scraper attachment arm including a through opening and a protrusion extending from the arm and positioned lower than the through opening. A mount protrusion extends laterally from the rotatable support and including a shaft and an enlarged head, the enlarged head sized to prevent passage through at least a portion of the through opening. A shoulder is located on the support and a stop surface is located on the support and positioned lower than the mount protrusion. When the bowl scraper is connected to the support in an operating position, the mount protrusion extends through the portion of the through opening, part of the attachment arm is located adjacent the shoulder for preventing rotation of the bowl scraper about the mount protrusion in at least one direction, and the attachment arm protrusion is located adjacent the stop surface for preventing movement of the bowl scraper in at least one direction along the through opening.

In another aspect, a bowl scraper for use in a mixing machine includes an attachment arm having an upper arm portion and a lower arm portion. The upper arm portion includes a through opening having a first portion and a second portion, the first portion of the through opening larger than the second portion of the through opening. A protrusion extends from the upper arm portion and positioned lower than the through opening. A scraper extends downward from the lower arm portion.

In yet another aspect, a bowl scraper for use in a mixing machine includes an attachment arm having an upper arm portion and a lower arm portion. The upper arm portion includes a through opening having at least a portion that defines an install location of the through opening. A protrusion extends from the upper arm portion and is positioned lower than the install location. A scraper extends downward from the lower arm portion.

In a further aspect, a method of maintaining a bowl scraper on a mixing machine during a scraping operation involves connecting the bowl scraper on a rotatable support via passage of an opening in an attachment arm of the bowl scraper over a mount protrusion of the support; urging a portion of the attachment arm against a side shoulder of the support by forces exerted on the bowl scraper during its scraping operation to prevent rotation of the attachment arm about the mount protrusion; and urging a portion of the bowl scraper against a stop surface of the support by upward forces exerted on the bowl scraper during its scraping operation to prevent upward movement of the bowl scraper.

DETAILED DESCRIPTION

Figure 1:
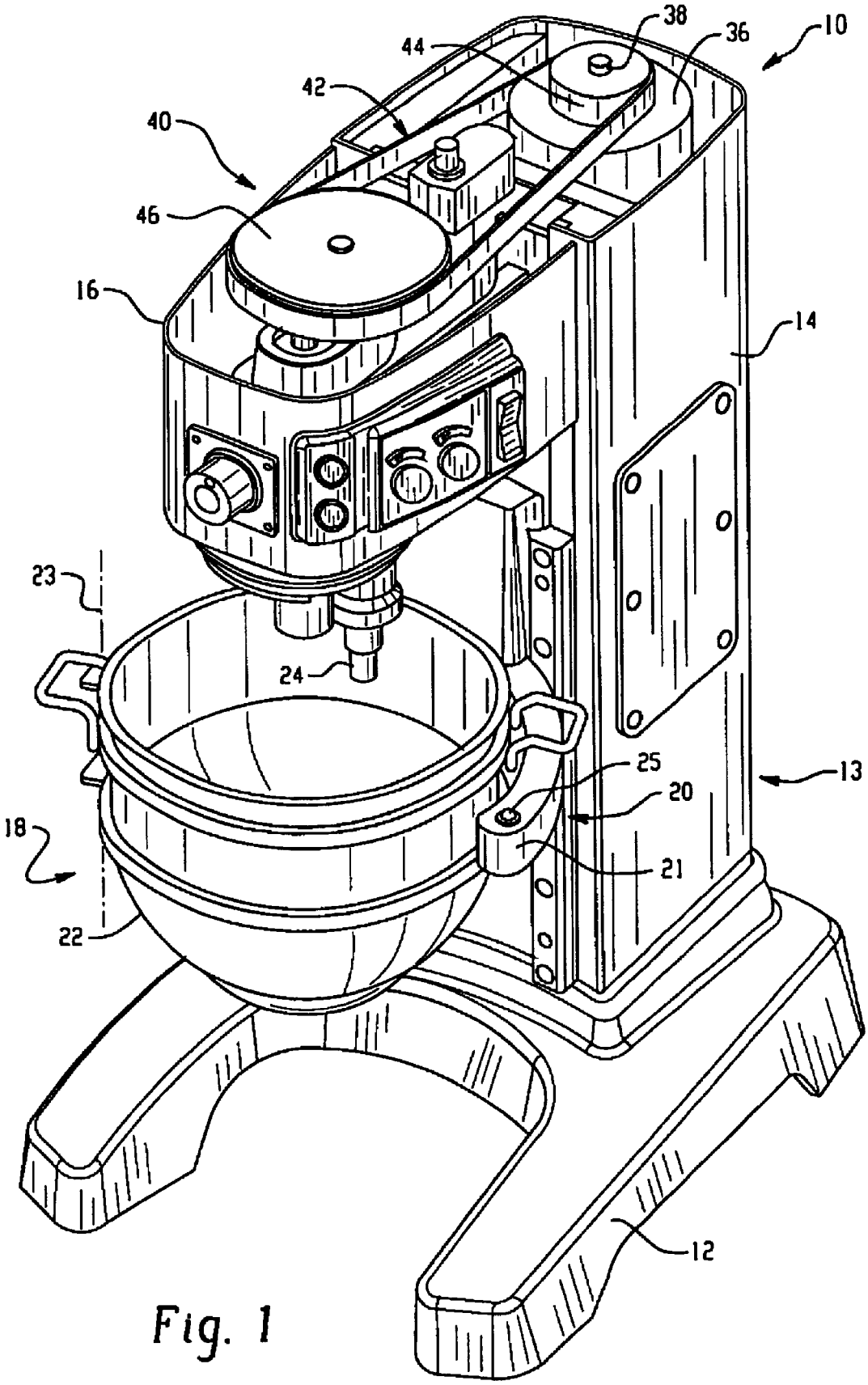
FIG. 1 is a perspective view of a mixing machine with the top cover removed.
Figure 2:
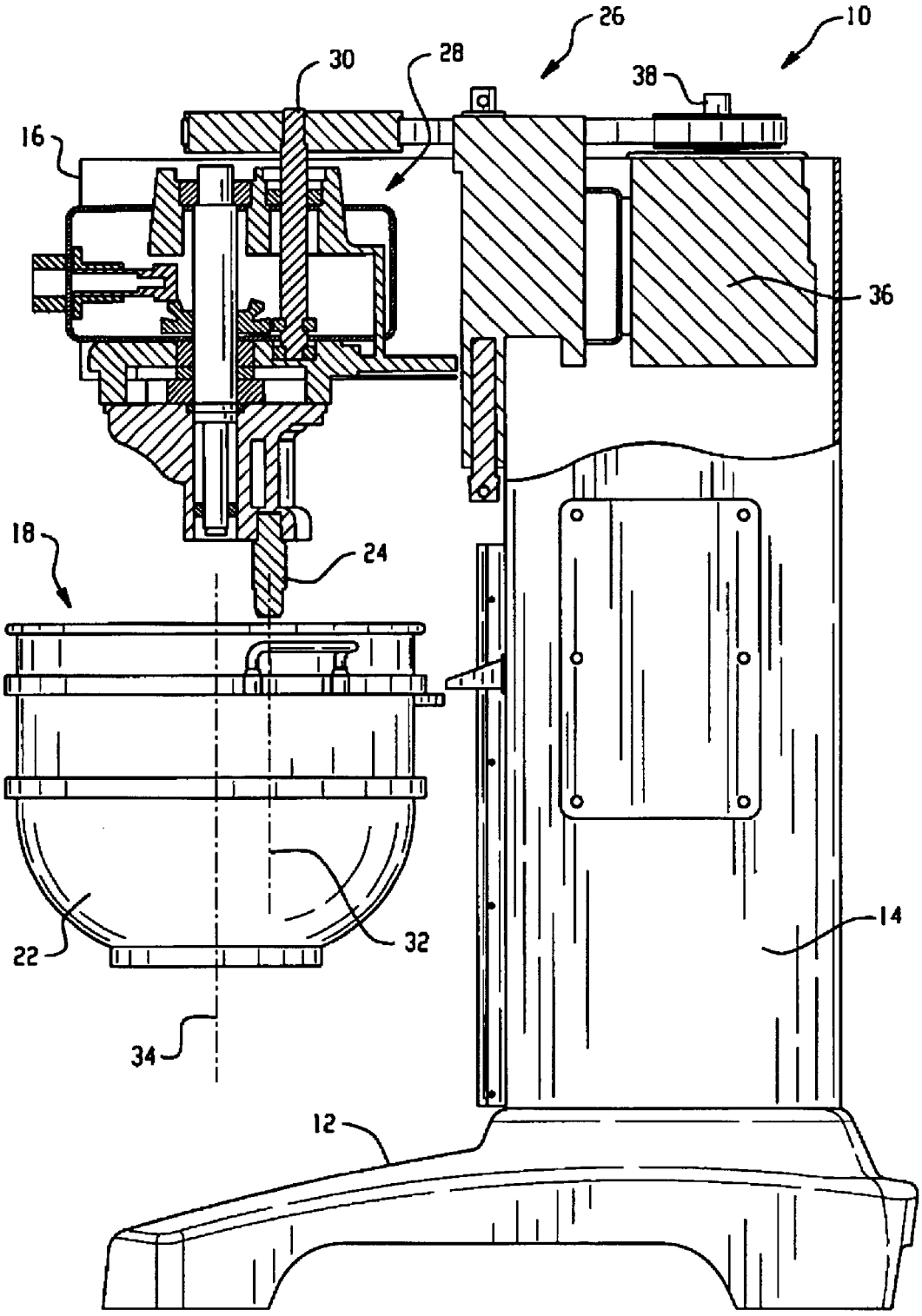
FIG. 2 is a side elevation of the mixing machine of FIG. 1 in partial cross-section.

Referring to FIGS. 1–2, a mixing machine 10 is shown and includes a base 12, a mixer body 13 including a column 14 extending upward from the base 10, and a head 16 extending outward from the column 14 and over a bowl receiving location 18. The bowl receiving location 18 may be defined by a bowl receiving portion 20 of the mixer body 13, where the bowl receiving portion 20 has spaced apart curved arms 21 defining a curved shape to match the bowl 22. The head includes a downwardly extending rotatable output member 24 that can receive a mixer tool such as a flat beater, whisk or other tool. The head 16 and upper portion of the column 14 typically include a detachable cover (not shown) for enclosing the components.

The mixing machine includes a drive assembly 26 for effecting rotation of the rotatable output member 24. In the illustrated machine the drive assembly is formed in part by a gear system 28 within the head 16 and having an upwardly extending input drive shaft 30. In the case of a planetary mixer, the gear system 28 may take the form of a planetary gear system, in which case the rotatable output member 24 rotates about its own axis 32, with the axis 32 rotating or "orbiting" around a central bowl axis 34. Also forming part of the drive assembly is a drive motor 36 that is mounted and located in line with the column 14 and includes an upwardly extending output shaft 38. A drive linkage 40 connects the motor output shaft 38 to the gear system input shaft 30 and may be formed by the illustrated belt 42 and pulleys 44 and 46. Alternative drive linkages could take the form of chain and sprocket combinations, additional gearing and/or bar-type linkages. The illustrated drive linkage 40 is a fixed linkage, meaning that the drive ratio between the motor output shaft 38 and the gear system input shaft 30 does not change.

The bowl 22 may be pivotally mounted for movement about a pivot axis 23 at one side of the bowl receiving portion 20, with the other side of the bowl receiving portion including a pin 25 for engaging part of the bowl and holding it in an operating position. Further details of such pivoting bowl arrangements are provided in U.S. Patent Application Publication No. 2002/0093877 A1, published Jul. 18, 2002.

Figure 3:
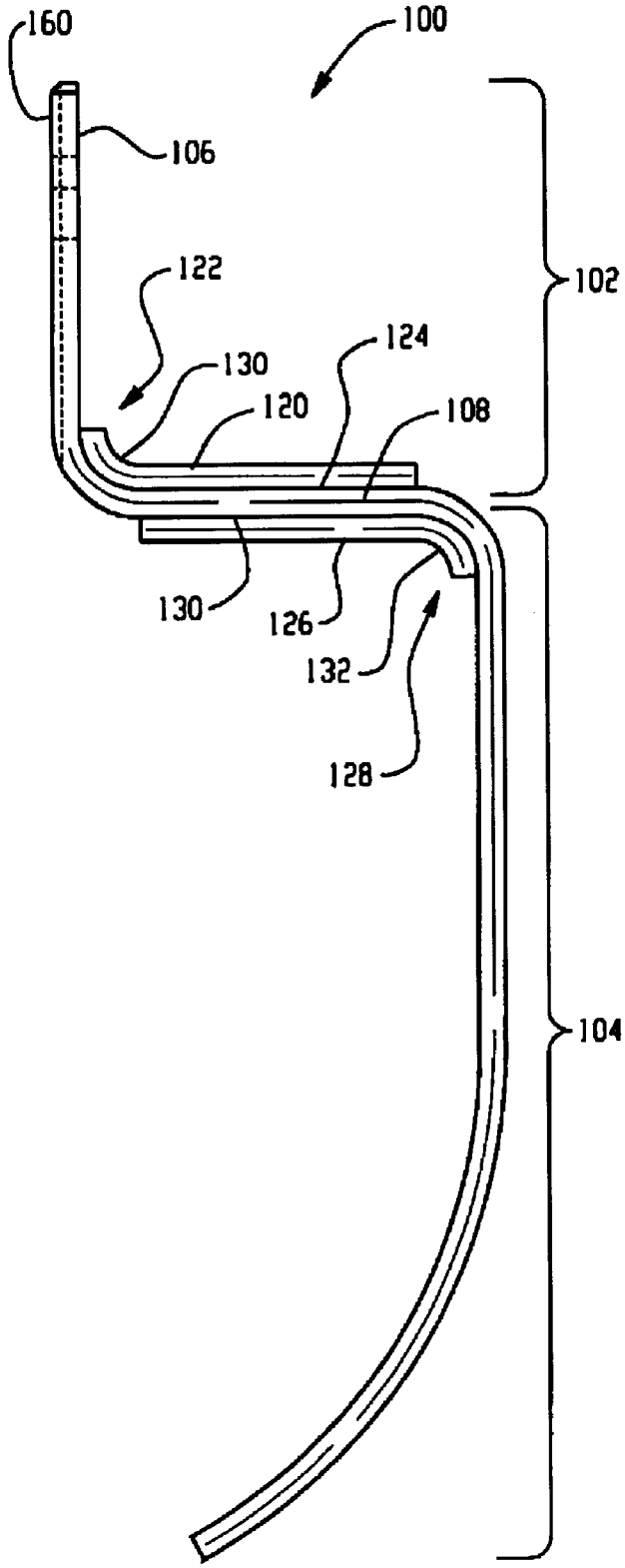
FIG. 3 is a side elevation of a bowl scraper.
Figure 4:
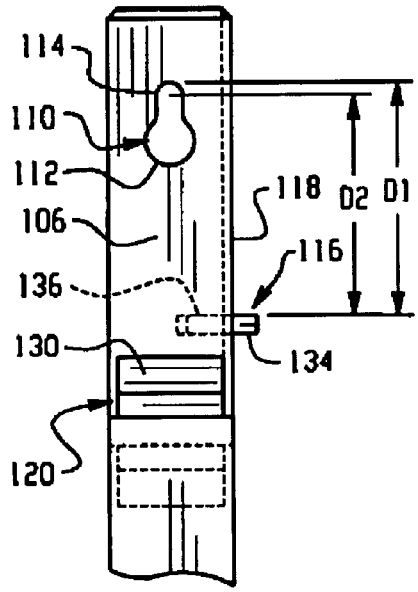
FIG. 4 is a partial front elevation of the bowl scraper of FIG. 4.

Referring now to FIGS. 3 and 4, a bowl scraper 100 and related attachment arrangement are now described. In particular, the bowl scraper 100 includes an attachment arm 102 and a scraper 104. The attachment arm 102 includes an upper arm portion 106 and a lower arm portion 108. The upper arm portion 106 includes a through opening 110 having a lower portion 112 and an upper portion 114, the lower portion 112 larger than the upper portion 114. A protrusion 116 extends from a side 118 of the upper arm portion 106 and is spaced below the through opening 110.

The illustrated attachment arm 102 is substantially L-shaped, with upper arm portion 106 extending substantially vertically and lower arm portion 108 extending laterally from the upper arm portion 106. The scraper 104 extends downward from the lower arm portion 108. The attachment arm 102 and scraper 104 may be unitary with each other, with both portions being formed by bending an elongated steel member. The scraper 104 is bent to an appropriate shape to match a bowl to be scraped and may typically also include a urethane sleeve that slides onto the bent steel member.

An upper brace 120 extends from a region 122 of intersection of the upper arm portion 106 and the lower arm portion 108 and toward the scraper 104 along an upper side of 124 the lower arm portion 108. Similarly, a lower brace 126 extends from a region 128 of intersection of the lower arm portion 108 and the scraper 104 and toward the upper arm portion 106 along a lower side 130 of the lower arm portion 108. Both braces may be formed of steel that is welded to the primary elongated steel member forming the implement. As illustrated, each brace 120 and 126 may includes a respective curved portion 130 and 132 in the respective region 122 and 128 to match the curvature of such regions. The braces 120 and 126 add strength to the implement.

The protrusion 116 may be formed by a pin 134 that is inserted into an opening 136 machined in the side 118 of the upper arm portion 106. Alternatively, the protrusion could be formed unitary with the upper arm portion. In certain embodiments the protrusion could, for example, extend from the back side of the upper arm portion. In one embodiment, a distance D1 between a top edge of the through opening 110 and a top edge of the protrusion 116 is between about 3.2 inches and about 3.4 inches, and is preferably about 3.3 inches. The smaller portion 114 represents an install location of the through opening 110, and in one embodiment a distance D2 between a mid-point of the install location and the top edge of the protrusion 116 is between about 3.0 and 3.2 inches, and preferably about 3.125 inches.

Figure 5:
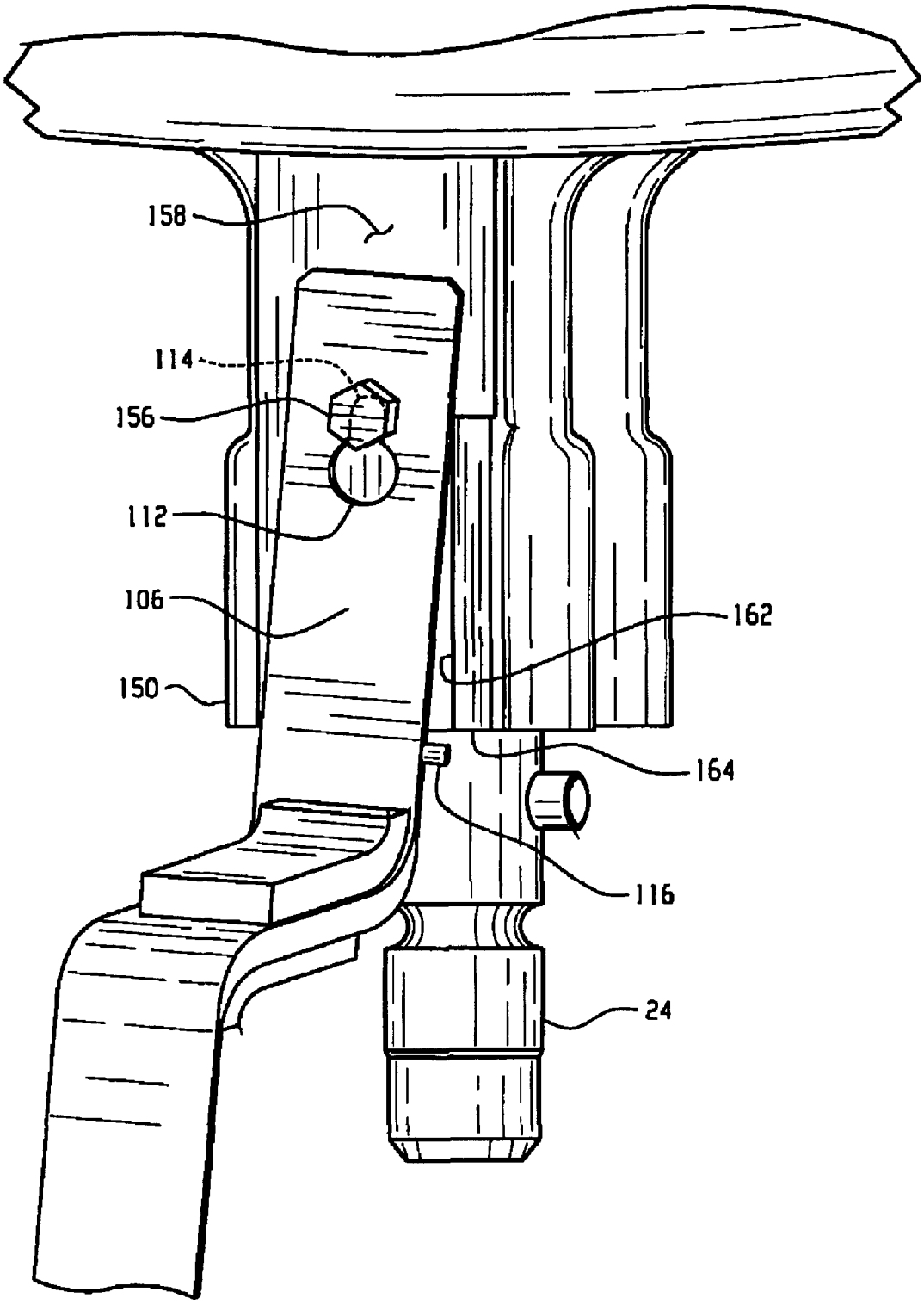
FIG. 5 is a partial perspective view of the bowl scraper of FIG. 4 being installed on a mixing machine.
Figure 6:
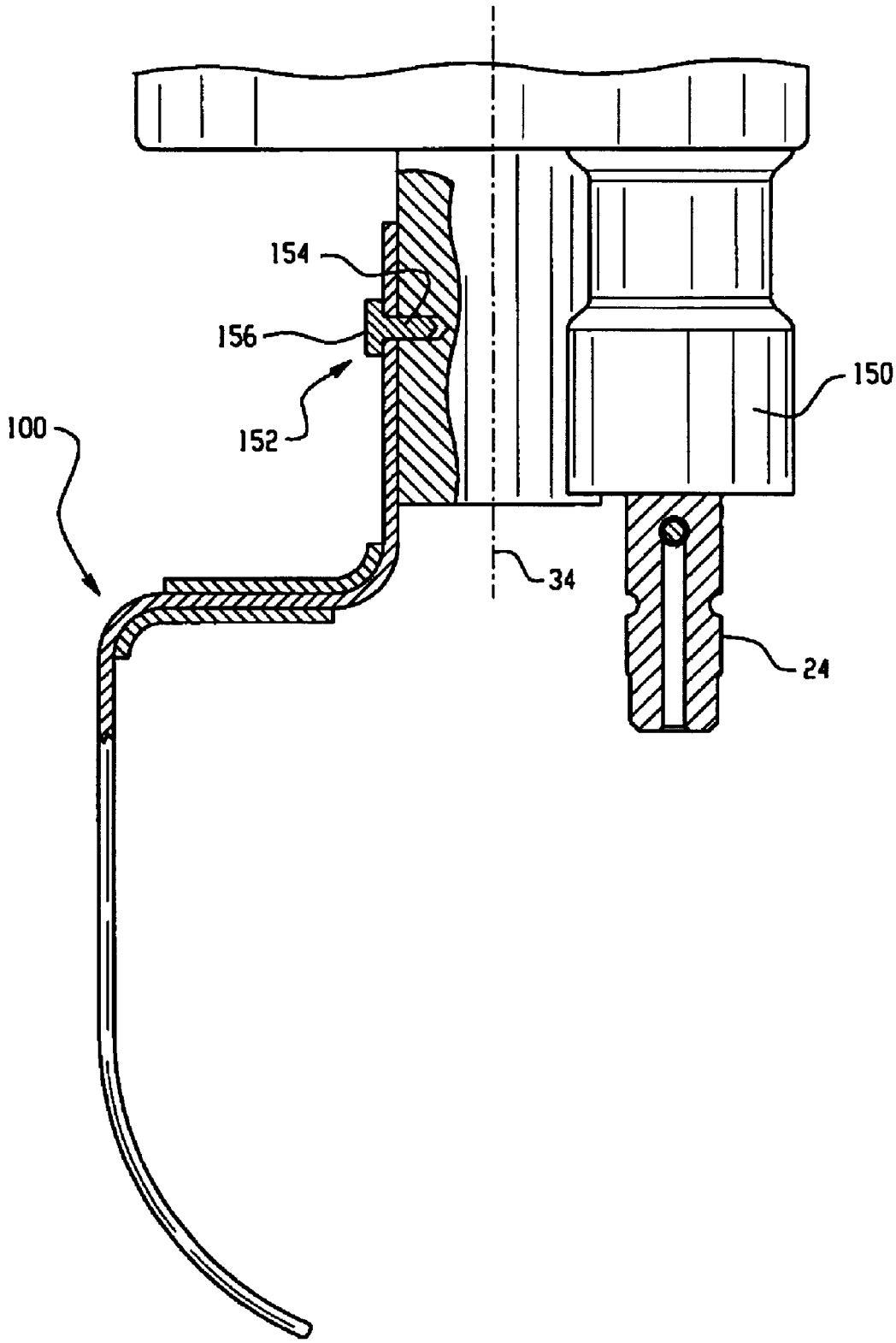
FIG. 6 is a side cross-section of the bowl scraper when installed on the mixing machine.

Reference is now made to FIGS. 5 and 6 for a description of the use of the scraper arm 100. In particular, FIG. 5 shows the underside of a mixer head including a rotatable output member 24 in the form of a shaft for receiving a mixer tool. The member 24 extends from a support 150 that is rotated about axis 34 during mixing operations. The support 150 includes a laterally extending mount protrusion 152 including a shaft 154 and an enlarged head 156 spaced from the support 150. The mount protrusion 152 may be formed by a bolt inserted through a spacer into a threaded opening of the support 150, with the opening formed on a substantially planar surface portion 158 of the support 150 to permit the back side 160 of upper arm portion 106 to lie thereagainst. The enlarged head 156 is sized to permit passing through the lower portion 112 of through opening 110, but to prevent passing through the upper portion 114 of the through opening. The support 150 also includes a side shoulder 162 spaced from the mount protrusion 152, with the shoulder 162 laterally raised relative to the surface portion 158. In the illustrated embodiment the side shoulder 162 extends substantially vertically and begins at or below a height of the mount protrusion and extends downward. A lower stop surface 164 is provided on the underside of support 150, spaced below the mount protrusion 152.

In order to mount the scraper 100 onto the mixing machine, support 150 is rotated about axis 34 to bring support surface 158 toward a front of the mixing machine 10. Bowl 22 is unlatched from support arm 21 at pin 25 and pivoted about axis 23 to facilitate access to support surface 158. The lower portion 112 of the through opening is aligned with the protrusion 152 and a lower part of the upper arm portion 106 is angled away from the side shoulder 162. The scraper 100 is then moved toward the support 150 to pass the enlarged head 152 of the protrusion through the through opening. The scraper is then moved to locate the shaft 154 of the protrusion 152 in the upper portion 114 of the through opening, such position being shown in FIG. 6. The scraper is then rotated (counterclockwise about mount protrusion 152 of FIG. 5) to position part of the upper arm portion 106 against the side shoulder 162 and to locate the protrusion 116 below and adjacent the stop surface 164. The bowl 22 is then pivoted back around axis 23 to its latched, operating position.

In this resulting, installed position the side shoulder 162 cooperates with the side of the upper arm portion 106 to prevent further counterclockwise rotation about the mount protrusion 152, the forces exerted on the scraper during scraping acting to push the side of the upper arm portion 106 into the side shoulder. The protrusion 116 cooperates with the stop surface 164 to prevent the scraper from sliding upward along the support 150, the forces exerted upward on the scraper during scraping acting to push the protrusion against the stop surface 164. Additionally, forces exerted on the scraper during scraping will also tend to urge the upper arm portion 106 toward the enlarged head 156 of the mount protrusion 152. Thus, the scraper is held in place by mechanical forces exerted on in it during scraping operations. To remove the scraper, support 150 is rotated about axis 34 to bring support surface 158 toward a front of the mixing machine 10. Bowl 22 is unlatched from support arm 21 at pin 25 and pivoted about axis 23 to facilitate access to the support surface 158. The upper arm portion is rotated away from the side shoulder 162, the scraper arm is moved upward to position the head in the lower portion 112 of the through opening, and the scraper is pulled laterally away from the support 150.

Figure 7A:
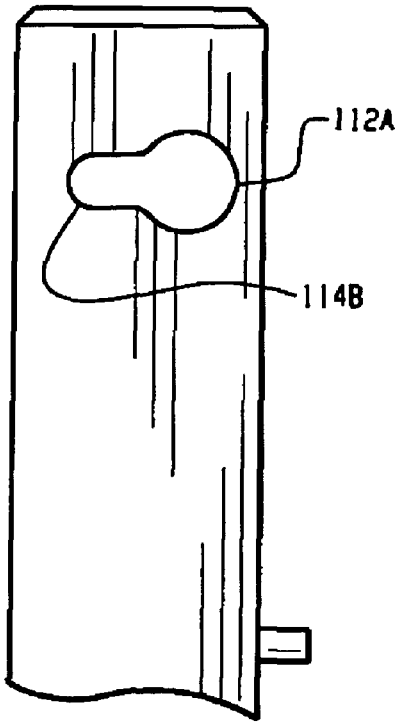
FIGS. 7A–7D show alternative scraper attachment arm embodiments.
Figure 7B:
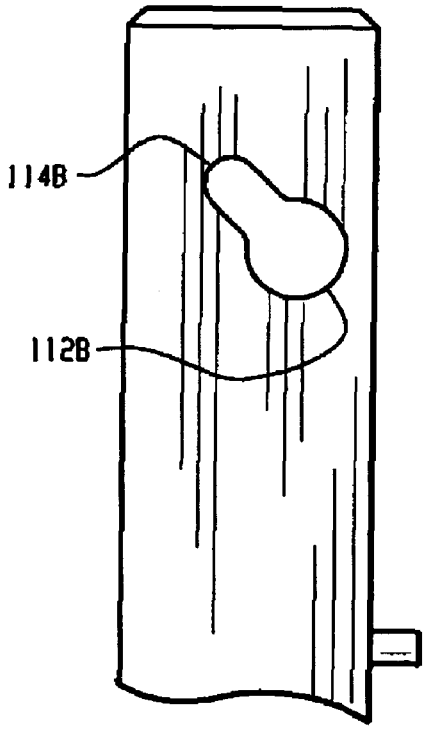
Figure 7C:
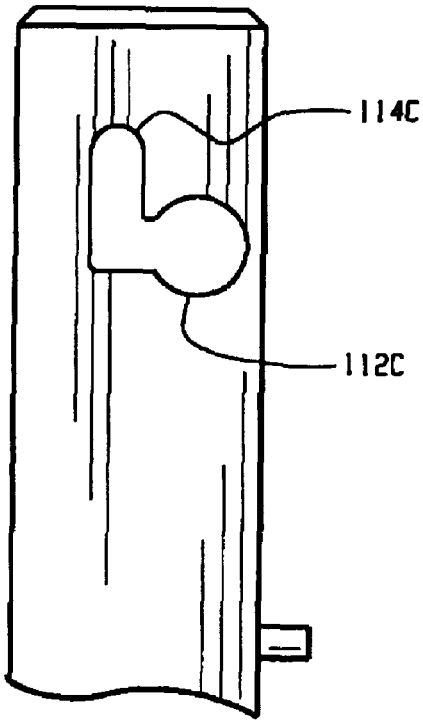
Figure 7D:
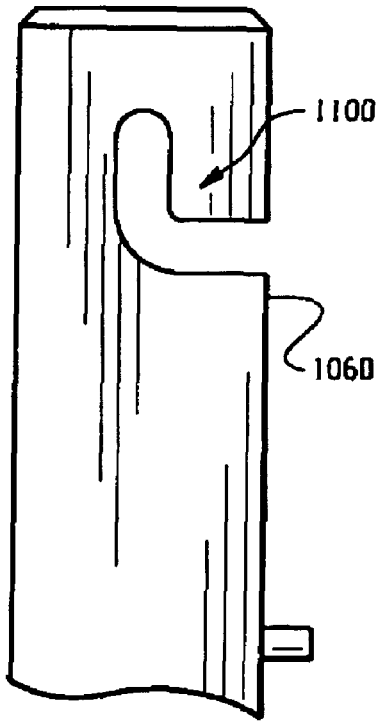

While the above-described embodiment provides a through opening in which the enlarged portion is located below the smaller portion, it is recognized that variations are possible. For example, reference is made to FIGS. 7A–7D where alternative opening configurations for the bowl scraper are shown. FIG. 7A shows an embodiment positioning the enlarged portion 112A laterally alongside the smaller portion 114A. FIG. 7B shows an embodiment positioning the enlarged portion 112B at a position diagonally offset from the smaller portion 114B. FIG. 7C shows an embodiment in which the larger portion 112C is positioned alongside and below the smaller portion 114C by an L-shaped bend. FIG. 7D shows an embodiment in which the entire opening 110D is sized to prevent passage of the enlarged head 156, but the opening extends all the way to the edge of the upper arm portion 106D to allow the shaft 154 of the mount protrusion 152 to be slid into the opening. In another variation the enlarged part of the opening could be positioned above the smaller part. In the latter case the protrusion extending from the scraper arm could be positioned in a slot, such as a slot in the side shoulder, to prevent both upward and downward movement of the bowl scraper.

In another variation of the previously mentioned embodiment in which the protrusion extends from the back side of the scraper arm, the protrusion could be formed by the extending part of a pin that is spring-loaded into the scraper arm itself. In such an embodiment the surface 158 would include an opening formed therein to receive the pin when the scraper is mounted to the mixer. In such an embodiment, it is possible that the side shoulder and support surface could both be formed by the wall of the opening formed in the surface 158.

It is to be clearly understood that the above description is intended by way of illustration and example only and is not intended to be taken by way of limitation. Other changes and modifications could be made, including both narrowing and broadening variations and modifications of the appended claims.

What is claimed is:

1. A bowl scraper for use in a mixing machine, comprising:

an attachment arm including an upper arm portion and a lower arm portion formed by respective parts of a bent elongated member, the upper arm portion including a through opening extending through the bent elongated member, the through opening having a first portion and a second portion, the first portion of the through opening larger than the second portion of the through opening, a protrusion extending from the upper arm portion and positioned lower than the through opening; and a scraper extending downward from the lower arm portion.

2. The bowl scraper of claim 1 wherein the first portion of the through opening is located lower than the second portion of the through opening.

3. The bowl scraper of claim 2 wherein a distance between a top edge of the second portion of the through opening and a top edge of the protrusion is between about 3.2 inches and about 3.4 inches.

4. The bowl scraper of claim 1 wherein the first portion of the through opening defines a connect/disconnect location of the through opening and the second portion of the through opening defines an install location of the through opening.

5. The bowl scraper of claim 4 wherein a distance between a mid-point of the install location and a top edge of the protrusion is between about 3.0 inches and 3.2 inches.

6. The bowl scraper of claim 1 wherein the attachment arm and the scraper are unitary with each other.

7. The bowl scraper of claim 6 wherein the attachment arm and the scraper are portions of an elongated, bent steel member.

8. The bowl scraper of claim 7 wherein the attachment arm is substantially L-shaped.

9. The bowl scraper of claim 1, further comprising:

an upper brace extending from a region of intersection of the upper arm portion and the lower arm portion and toward the scraper along an upper side of the lower arm portion.

10. The bowl scraper of claim 9, further comprising:

a lower brace extending from a region of intersection of the lower arm portion and the scraper and toward the upper arm portion along a lower side of the lower arm portion.

11. The bowl scraper of claim 1 wherein the protrusion comprises a pin inserted into a side of the upper arm portion.

12. The bowl scraper of claim 1 wherein the first portion of the through opening is located at least laterally of the second portion of the through opening.

13. A mixing machine, comprising:

a head located above a bowl receiving area;

a rotatable output member extending downwardly from the head and adapted for receiving a mixer tool;

a rotatable scraper support extending downwardly from the head and having a laterally extending mount protrusion including a shaft and an enlarged head, the scraper support including a side shoulder and a stop surface; and a bowl scraper including an attachment arm including an upper arm portion and a lower arm portion, the upper arm portion including a through opening having a first portion and a second portion, the first portion of the through opening larger than the second portion of the through opening, a protrusion extending from the upper arm portion and positioned lower than the through opening; and a scraper extending downward from the lower arm portion;

the bowl scraper mounted on the scraper support with the mount protrusion extending through the second portion of the through opening, the enlarged head sized to prevent passing through the second portion of the through opening, the side of the upper arm portion of the attachment arm located adjacent the side shoulder for preventing rotation of the bowl scraper about the mount protrusion in one direction, and the attachment arm protrusion located adjacent the stop surface for preventing upward movement of the bowl scraper.

14. A bowl scraper for use in a mixing machine, comprising:

an attachment arm including an upper arm portion and a lower arm portion formed by respective parts of a bent elongated member, the upper arm portion including a through opening extending through the bent elongated member, the through opening having at least a portion that defines an install location of the through opening, a protrusion extending from the upper arm portion and positioned lower than the install location; and a scraper extending downward from the lower arm portion.

15. The bowl scraper of claim 14 wherein a distance between a mid-point of the install location and a top edge of the protrusion is between about 3.0 inches and 3.2 inches.

16. The bowl scraper of claim 14 wherein the protrusion extends from a side of the upper arm portion.

17. The bowl scraper of claim 14 wherein the through opening extends to a side of the upper arm portion.

18. In a mixing machine including a rotatable support extending from a mixer head, a connecting and support system for quickly connecting and disconnecting a bowl scraper, the connecting and support system comprising:

a bowl scraper attachment arm including a through opening and a protrusion extending from the arm and positioned lower than the through opening;

a mount protrusion extending laterally from the rotatable support and including a shaft and an enlarged head, the enlarged head sized to prevent passage through at least a portion of the through opening;

a shoulder on the support; and a stop surface on the support and positioned lower than the mount protrusion;

when the bawl scraper is connected to the support in an operating position, the mount protrusion extends through the portion of the through opening, part of the attachment arm is located adjacent the shoulder for preventing rotation of the bowl scraper about the mount protrusion in at least one direction, and the attachment arm protrusion is located adjacent the stop surface for preventing movement of the bowl scraper in at least one direction along the through opening.

19. The connecting and support system of claim 18 wherein the through opening includes an enlarged portion sized to permit passage of the enlarged head therethrough.

20. The connecting and support system of claim 18 wherein the through opening extends to a side of the upper arm portion.

21. The connecting and support system of claim 18 wherein the protrusion extends from a back side of the attachment arm and the shoulder and stop surface are formed by an edge or respective edges of an opening in the support that aligns with the protrusion when the bowl scraper is connected to the support in the operating position.

22. The connecting and support system of claim 18 wherein, when the bowl scraper is connected to the support in the operating position, the attachment arm can rotate at least partially about the mount protrusion in a direction opposite the one direction to facilitate disconnecting the bowl scraper from the support.

23. The connecting and support system of claim 22 wherein the shoulder is spaced laterally from the mount protrusion and begins at or below a height of the mount protrusion and extends vertically downward.

24. A method of maintaining a bowl scraper on a mixing machine during a scraping operation, the method comprising the steps of:

connecting the bowl scraper on a rotatable support via passage of an opening in an attachment arm of the bowl scraper over a mount protrusion of the support;

urging a portion of the attachment arm against a side shoulder of the support by forces exerted on the bowl scraper during its scraping operation to prevent rotation of the attachment arm about the mount protrusion; and urging a portion of the bowl scraper against a stop surface of the support by upward forces exerted on the bowl scraper during its scraping operation to prevent upward movement of the bowl scraper.

25. A bowl scraper for use in a mixing machine, comprising:

an attachment arm including an upper arm portion and a lower arm portion, the upper arm portion including a through opening having a first portion and a second portion, the first portion of the through opening larger than the second portion of the through opening, a protrusion extending from the upper arm portion and positioned lower than the through opening; and a scraper extending downward from the lower arm portion wherein the first portion of the through opening is located lower than the second portion of the through opening.

26. The bowl scraper of claim 25 wherein a distance between a top edge of the second portion of the through opening and a top edge of the protrusion is between about 3.2 inches and about 3.4 inches.

27. A bowl scraper for use in a mixing machine, comprising:

an attachment arm including an upper arm portion and a lower arm portion, the upper arm portion including a through opening having a first portion and a second portion, the first portion of the through opening larger than the second portion of the through opening, a protrusion extending from the upper arm portion and positioned lower than the through opening;

a scraper extending downward from the lower arm portion; and an upper brace extending from a region of intersection of the upper arm portion and the lower arm portion and toward the scraper along an upper side of the lower arm portion.

28. The bowl scraper of claim 27, further comprising:

a lower brace extending from a region of intersection of the lower arm portion and the scraper and toward the upper arm portion along a lower side of the lower arm portion.

* * * * *

UNITED STATES PATENT AND TRADEMARK OFFICE

CERTIFICATE OF CORRECTION

PATENT NO. : 6,866,413 B2
DATED : March 15, 2005
INVENTOR(S) : Thomas S. Donthnier It is certified that error appears in the above-identified patent and that said Letters Patent is hereby corrected as shown below:

Column 7,
Line 1, change "bawl" to -- bowl --.

Signed and Sealed this

Thirty-first Day of May, 2005

JON W. DUDAS
*Director of the United States Patent and Trademark Office*